United States Patent [19]

Bodine

[11] 4,266,619

[45] May 12, 1981

[54] DOWN HOLE CYCLOIDAL DRILL DRIVE

[76] Inventor: Albert G. Bodine, 7877 Woodley Ave., Van Nuys, Calif. 91406

[21] Appl. No.: 76,194

[22] Filed: Sep. 17, 1979

Related U.S. Application Data

[63] Continuation-in-part of Ser. No. 64,046, Aug. 6, 1979, and a continuation-in-part of Ser. No. 63,840, Aug. 6, 1979.

[51] Int. Cl.[3] ..... E21B 7/24

[52] U.S. Cl. ..... 175/55; 175/107

[58] Field of Search ..... 175/55, 56, 106, 107, 175/343; 166/177; 74/87

[56] References Cited

U.S. PATENT DOCUMENTS

| | | | |
|---|---|---|---|
| 1,954,166 | 4/1934 | Campbell | 175/336 |
| 2,951,681 | 9/1960 | Degen | 175/56 X |
| 3,049,185 | 8/1962 | Herbold | 175/55 |
| 3,211,243 | 10/1965 | Bodine, Jr. | 175/55 X |
| 3,291,228 | 12/1966 | Bodine, Jr. | 175/55 |
| 3,487,244 | 12/1969 | Kessler | 74/87 |
| 3,612,627 | 10/1971 | Fuller | 175/325 |

FOREIGN PATENT DOCUMENTS

| | | | |
|---|---|---|---|
| 48836 | 12/1964 | Poland | 175/55 |
| 48941 | 12/1964 | Poland | 175/55 |

*Primary Examiner*—James Leppink
*Assistant Examiner*—Richard E. Favreau
*Attorney, Agent, or Firm*—Edward A. Sokolski

[57] ABSTRACT

A drill stem has a drill bit for use in drilling a bore hole in an earthen formation, this drill bit being on the down hole end thereof. An eccentric mass rotor is mounted in the stem spaced between the opposite ends thereof. The rotation axis of the rotor is oriented such that when the rotor is rotatably driven a rotating force vector component is generated, this force vector lying in a plane substantially normal to the longitudinal axis of the bore hole. The rotating force vector causes a portion of the drill and stem assembly to precess or roll around against the wall of the bore hole in a cycloidal manner and in forceful engagement with the bore hole wall to thereby cause rotation of said drill stem about its own axis either to directly effect drilling action or aid drilling principally achieved by some other drive means coupled to the drill stem.

6 Claims, 11 Drawing Figures

DOWN HOLE CYCLOIDAL DRILL DRIVE

This application is a continuation-in-part of my Patent Applications Ser. Nos. 64,046 and 63,840, both filed Aug. 6, 1979, and entitled "Mechanically Nutating Drill Driven by Orbiting Mass Oscillator" and "Elastically Vibratory Longitudinal Jacketed Drill", respectively.

This invention relates to bore hole drilling, and more particularly to a cycloidal drilling system particularly suitable in the drilling of bore holes in earthen material.

In the drilling of bore holes in earthen material, such as oil well drilling, and also in pile driving, the installation of anchors, etc., it is helpful to rotate the cutting or penetrating tool at a moderate rpm to supplement longitudinal driving action which may be either mechanical or vibratory in nature. Such rotatable action is sometimes necessary for augering or cutting action or to reduce the friction of the member as it progresses through the earthen material and in other instances such rotation is needed to achieve indexing of the cutting tool, particularly in the case of vibratory drilling. Such rotary action is also particularly useful in connection with vibratory drilling where cycloidal-type rotation at relatively low cyclic speeds operates to index the cutting edge of the vibrating bit around the bore hole in a series of closely spaced contacts so as to effect highly efficient chipping action.

The system of the present invention provides means for efficiently effecting cycloidally induced rotary action of a drill tool or its bit in forceful drilling engagement against the bore hole wall to achieve the above indicated advantageous rotary operation of a drill which may be operated solely in this manner or may be simultaneously either mechanically or vibratorily driven in some other manner. The cycloidal friction drive of the present invention develops high torque rolling action against the sides of the bore hole which provides considerable rotational advantage when drilling through hard spots and in other high friction drilling situations. Further, in the system of the present invention, the cycloidal drive is generated "down hole" in a region close to the bit, obviating the need for transmitting rotary torque down a long drill string.

In achieving the above indicated end results, the system of the invention employs an eccentrically weighted orbiting rotor which is mounted down hole within the main drilling stem system at a position therealong toward the drill bit. The rotation axis of the orbiting rotor in certain embodiments of the invention is oriented substantially parallel to the longitudinal axis of the bore hole, while in other embodiments the rotation axis of the rotor may be angulated relative to the longitudinal axis of the bore hole. In any event, the orientation of the oscillator rotation axis must be such that when the rotor is rotatably driven, a high level rotatable force vector is generated at least in a plane transverse to the longitudinal axis of the bore hole. In embodiments of the invention where the rotation axis is angulated relative to the longitudinal axis of the bore hole, a longitudinal force vector is also generated which provides longitudinally vibratory drilling action which is useful in certain applications. The rotational force vector transverse to the bore hole causes a portion of the stem-bit assembly, which generally includes or is near to the drill bit, to precess or roll around against the bore hole surface in forceful frictional engagement therewith. This frictional cycloidal action may be used to aid the main drilling action provided by a torsional rectifier drill as described in my U.S. Pat. No. 3,633,688 or a standing wave vibratory drill as described in my U.S. Pat. No. 3,096,833; or in certain applications may provide the principal drilling action in itself.

It is therefore an object of this invention to provide an improved cycloidal drilling system which employs drive means located down hole within the drill stem.

It is another object of this invention to provide a cycloidal drilling system in which forceful rolling action of a portion of the drill stem assembly against the bore hole walls is effected.

Other objects of this invention will become apparent as the description proceeds in connection with the accompanying drawings of which:

Figure 1:
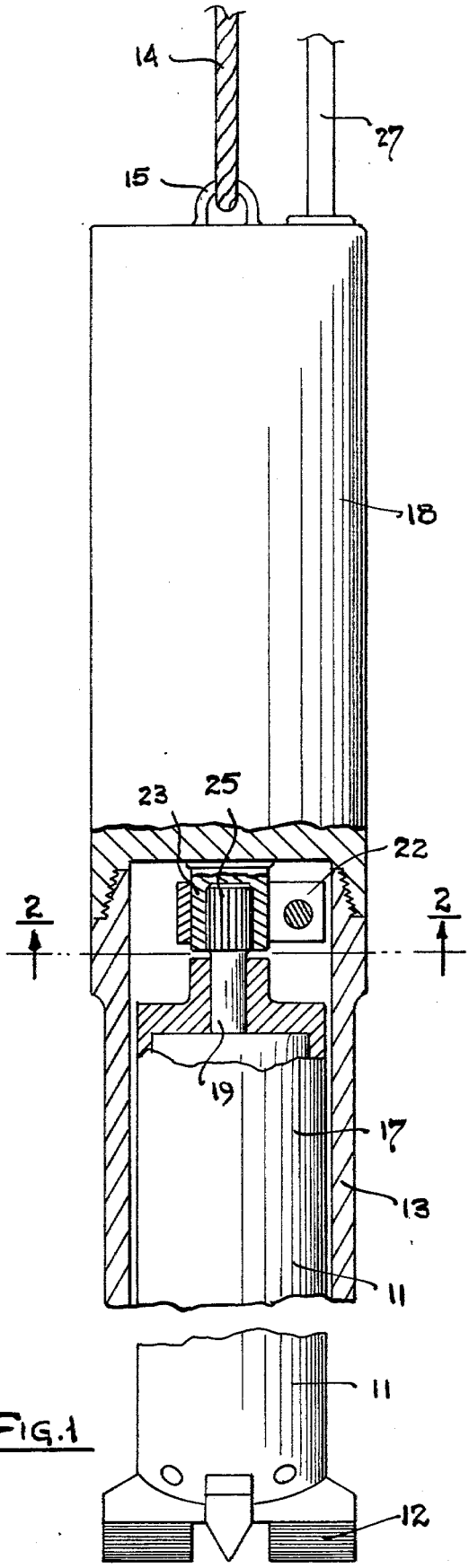
FIG. 1 is an elevational view partly in cross section illustrating a first embodiment of the invention.
Figure 2:
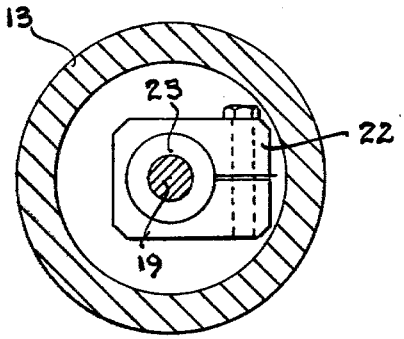
FIG. 2 is a cross-sectional view taken along the plane indicated by 2—2 in FIG. 1.

Referring now to FIGS. 1 and 2, a first embodiment of the invention is illustrated. This first embodiment may be incorporated into a vibratory jacketed earth boring drill such as described in my U.S. Pat. No. 3,096,833, issued July 9, 1963. The drill described in my aforementioned U.S. Pat. No. 3,096,833 includes a drill stem 11, partially contained within jacket 13 and which has a drill bit 12 on the lower end thereof and is suspended from above through jacket 13 by means of a cable 14 attached to eye 15. Cable 14 is thus used to lower the drill stem into a bore hole. An oscillator 17 also contained within jacket 13 and mounted on stem 11 is rotatably driven by motor 18 through shaft 19 to generate vibratory energy in drill stem 11 which is transferred to bit 12. The structure thus far alluded to is fully described in my aforementioned U.S. Pat. No. 3,096,833, and therefore such description will not be repeated herein. The novel portions of the present invention lie in the addition of unbalanced rotor member 22 which is clamped to drive shaft 23 of electric motor 18. The motor drive shaft 23 is also coupled to the drive shaft 19 of vibration generating oscillator 17 by means of splined coupling 25 to permit longitudinal vibration of oscillator 17. When motor 18 receives electrical power from cable 27, it simultaneously rotatably drives both unbalanced rotor member 22 and the rotor of vibratory frequency oscillator 17. The vibratory oscillator 17 causes the oscillatory vibration of stem 11 as described in my U.S. Pat. No. 3,096,833, while the rotation of unbalanced weight 22 generates a rotating force vector in the drill assembly, this force vector lying in a plane which is substantially normal to the longitudinal axis of the stem 11.

Figure 3:
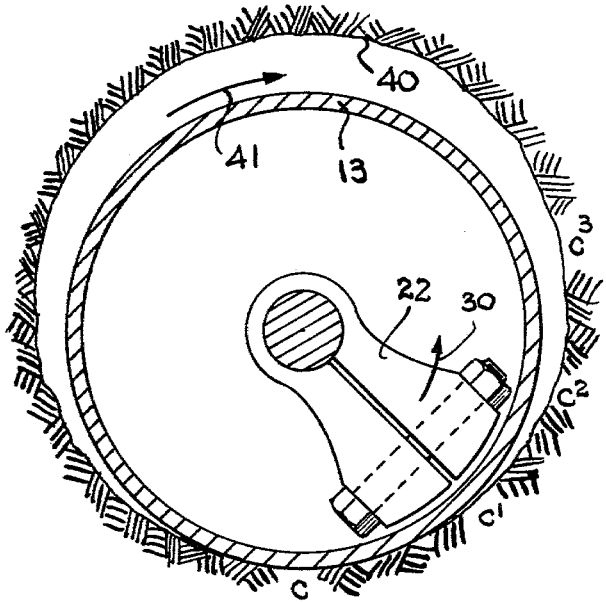
FIG. 3 is a schematic view illustrating the operation of the inventive system.

Referring now to FIG. 3, the effects of this rotating force vector are schematically illustrated. Arrow 30 indicates the rotation of the unbalanced weight 22 which forms a rotor which orbits around in drilling stem 11. Such rotation is typically at a speed of the order of 1800 rpm. The rotation of rotor 22 generates a rotating radial force which in turn causes a precession or rolling action of jacket 13 around the wall 40 of the drill hole bore in the direction indicated by arrow 41. This results in forceful engagement of successive portions of the jacket wall against the bore hole wall 40 as indicated by successive contact points C–$C^3$. The jacket thus precesses or rolls around against the bore hole wall, this rolling motion of the jacket being carried down to drill bit 12 as rotation indicated by arrow 41, to primarily effect the bit's forceful rotating engagement with the bottom bore hole surface being cut. Jacket 13 thus may precess with a conical motion, with bit 12 simply rotating as a pivot at the apex of the conical motion. It is to be noted that the rolling motion indicated by arrow 41 is at a low speed which is much lower than the relatively high speed of rotation of the rotor 21 as indicated by arrow 30.

Figure 4:
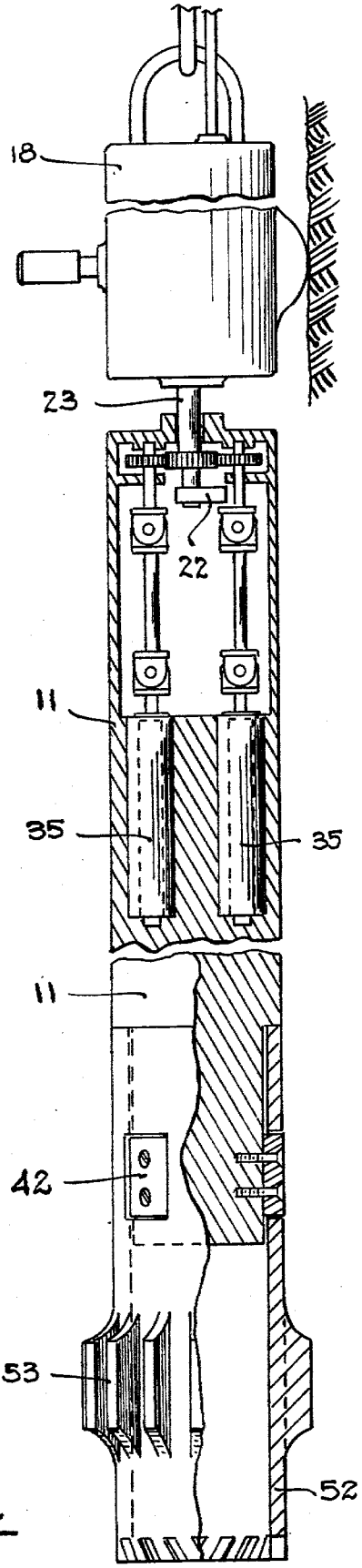
FIG. 4 is an elevational view in cross section of a further embodiment of the invention.
Figure 7:
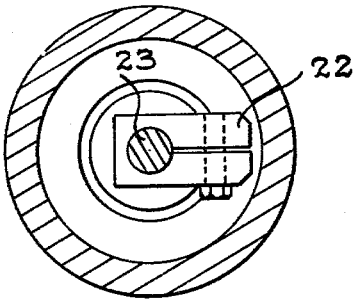
FIG. 7 is an elevational view illustrating a clamping mechanism for clamping the rotor to the motor drive shaft in the embodiments of FIGS. 4–6.

Referring now to FIG. 4, a further embodiment of the invention is illustrated. This embodiment is incorporated into a torsional rectifier drilling device as shown in FIG. 1 of my U.S. Pat. No. 3,633,688, issued Jan. 11, 1972, except for the addition of unbalanced rotor 22, which is attached to the drive shaft 23 of motor 18. Such attachment may be made either by welding or by clamping as illustrated in FIG. 7. As is fully explained in the aforementioned U.S. Pat. No. 3,633,688, rotors 35, which are eccentrically weighted, are rotatably driven to produce torsional standing wave resonant vibration of stem 11, this vibrational energy being transferred from the stem to the drill bit 52 in unidirectional pulses by virtue of the rectifier action of rectifier hammers 42. The rotation of unbalanced rotor 22 causes a precession or rolling engagement of the upper region of stem 11 and likewise of the lugs 53 against the bore hole wall (near the bit in this embodiment) as described in connection with FIG. 3. The torsional vibration of stem 11 is at a substantially higher frequency than the cycloidal rolling action of bit 52 engendered by the rotation of unbalanced rotor 22, the rolling action thus also operating to rotationally index the vibrational action at successive portions around the bore hole.

Figure 5:
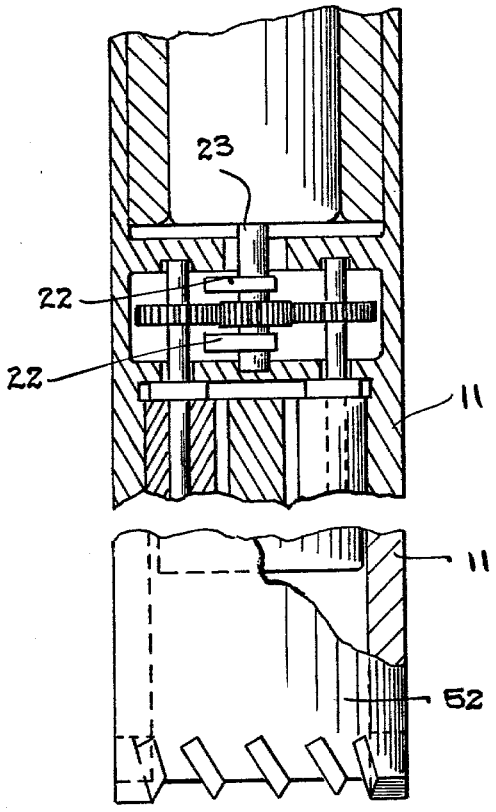
FIG. 5 is a cross-sectional view of still a further embodiment of the invention.

Referring now to FIG. 5, a further embodiment of the invention is illustrated, this embodiment being incorporated into the embodiment of my aforementioned U.S. Pat. No. 3,633,688 shown in FIG. 4 of that patent. In this embodiment, a pair of eccentric masses 22 are employed, these being welded to the motor drive shaft 23. As for the previously described embodiment, a cycloidal rolling and rotation motion of bit 52 is engendered by the rotation of masses 22 to index the vibratory action of the drill at various positions around the bore hole. For convenience of illustration, only a portion of the device illustrated in FIG. 4 of my U.S. Pat. No. 3,633,688 is illustrated herein, the remaining portions of this figure being hereby incorporated in the present application by reference.

Figure 6:
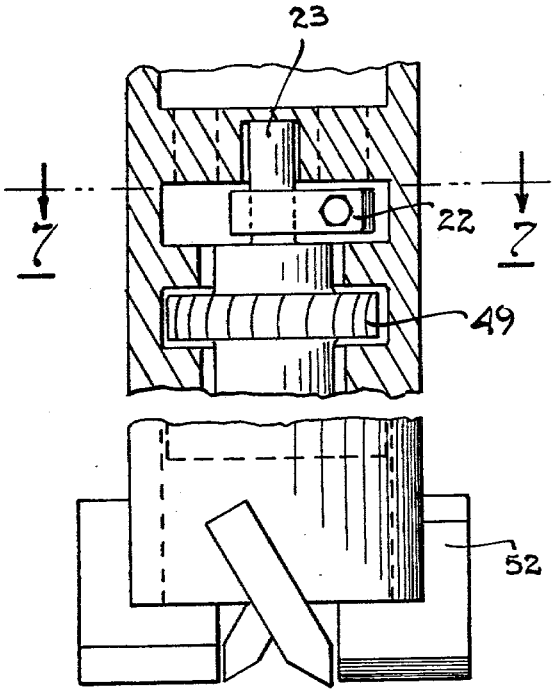
FIG. 6 is a cross-sectional view of still another embodiment of the invention.

Referring now to FIG. 6, a still further embodiment of the invention is illustrated, this embodiment being employed with the drill shown in FIG. 7 of my U.S. Pat. No. 3,633,688, which is incorporated herein by reference. In this embodiment, eccentric rotor 22 is attached to shaft 23 which is rotatably driven by mud turbine 49. Eccentric rotor 22 may be coupled to shaft 23 either by welding or by clamping attachment, as shown in FIG. 7. As for the previous embodiments, the rotation of eccentric rotor 22 engenders a cycloidal motion of the stem along with resulting rotation of the bit 52 which operates to index the bit around the bore hole to enhance the vibratory drilling action effected by the torsional vibration of the stem produced by an orbiting mass oscillator (not shown in FIG. 6).

Figure 8:
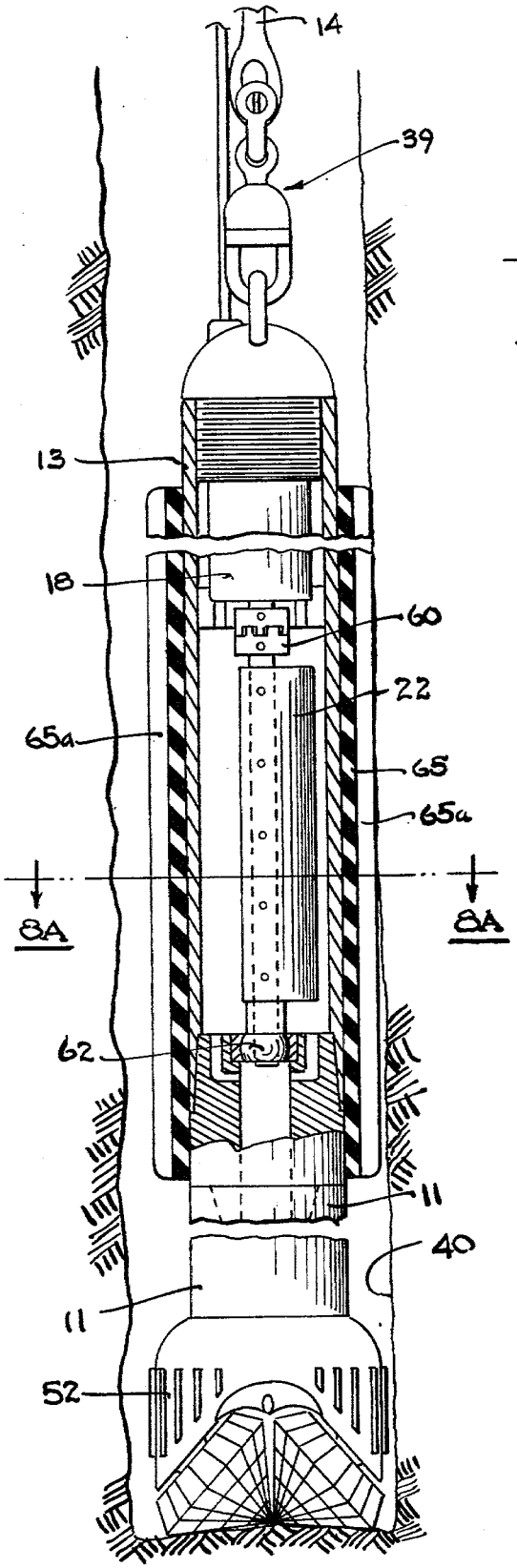
FIG. 8 is an elevational cross-sectional view of still a further embodiment of the invention.
Figure 8A:
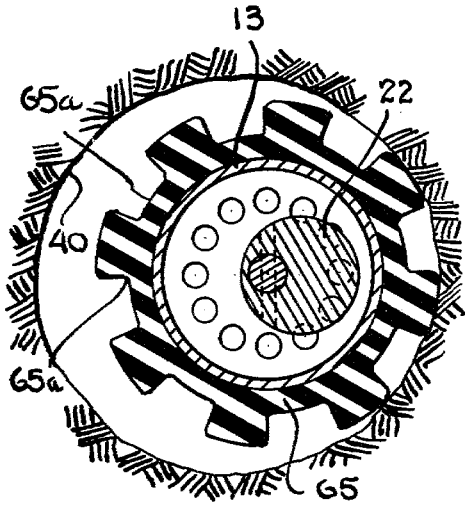
FIG. 8A is a cross-sectional view taken along the plane indicated by 8A—8A in FIG. 8.

Referring now to FIGS. 8 and 8A, a still further embodiment of the invention is illustrated. Drill stem 11 is suspended from cable 14 by means of coupler assembly 39 and housing 13 and lowered into bore hole 40 with its bit 52 in engagement with the bottom of the bore hole. Eccentric motor 22 is drivingly attached to the drive shaft of electric motor 18 by means of coupler 60, the bottom end of the shaft being supported on thrust bearing 62. Surrounding housing 13 and fixedly attached thereto, as for example by cementing, is a resilient bumper guard member 65 which may be of rubber. Guard member 65 has flutes **65*a* formed therein. When eccentric rotor 22 is rotatably driven, a cycloidal rolling motion of the upper portion of stem 11 is produced which results in rotation about the axis of bit stem 11 in response to a precessing rolling action of bumper guard 65 around the walls of bore hole 40 above the bit in forceful engagement against such walls. The bit 52 may be thus rolled around against the bore hole walls 40** in like fashion and also thus rotated against the hole bottom, turning on its own axis to effect drilling action. When using bits that do not tend to slide radially because of tooth shape, a large downward force may be used to "pin" the bit so that it only rotates and does not precess.

Figure 9:
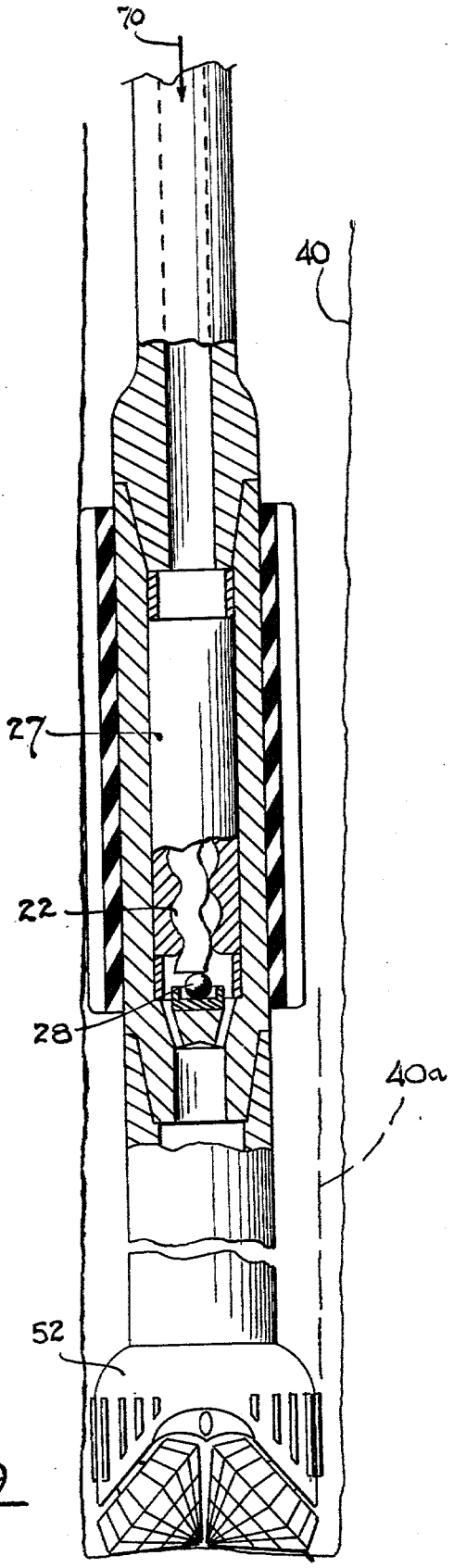
FIG. 9 is an elevational cross-sectional view of still another embodiment of the invention.

Referring now to FIG. 9, still a further embodiment of the invention is illustrated. This embodiment is similar to that previously described and operates in the same general cycloidal fashion except that the eccentric rotor is provided by a screw-type rotor 22 of the "moyno" type which is supported in a convoluted casing 27 on thrust bearing 29 and is driven by means of a mudstream fed into the top of the oscillator as indicated by arrow 70. This type of device is more completely described in my Patent Application Ser. No. 63,840 of which the present application is a continuation-in-part. If the bit is pinned down by high force, it becomes the above-described apex of a conical motion and the bore hole drilled is smaller as indicated at **40*a* in FIG. 9**.

Figure 10:
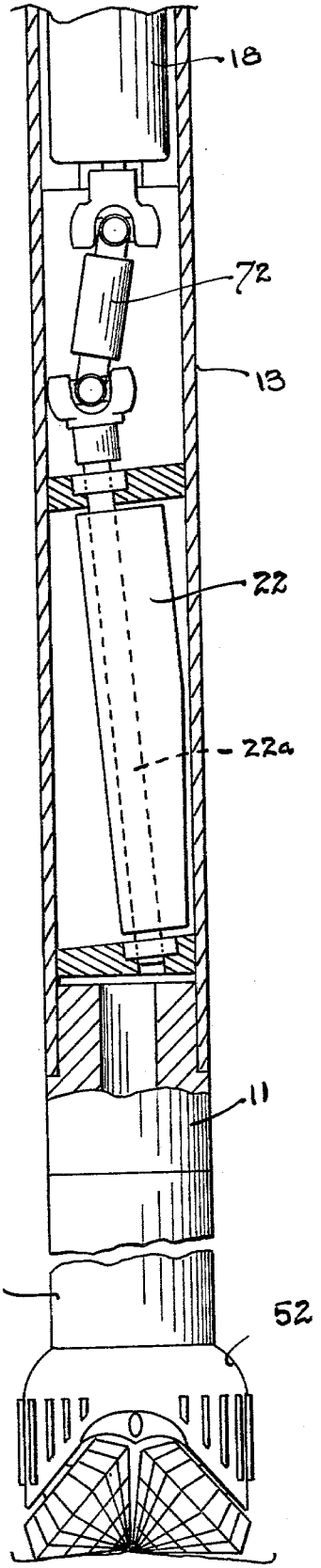
FIG. 10 is an elevational cross-sectional view of still a further embodiment of the invention.

Referring now to FIG. 10, still a further embodiment of the invention is illustrated. In this embodiment, the eccentric rotor 22 is mounted for rotation in housing 13 about an axis **22*a* which is angulated with respect to the longitudinal axis of the stem. The eccentric rotor 22 is rotatably driven by motor 18 which is coupled thereto by a universal coupler 72. With the rotation of mass 22, a force is generated in stem 11 which has two vectorial components, one of which comprises the major force component and is in a plane normal to the longitudinal axis of stem 11 and results in the above-described cycloidal precessional rotation of the stem, the other component being along the longitudinal axis of the stem and providing a cyclical drive force on the stem acting longitudinally. Thus, in this embodiment, the bit member 52** is simultaneously driven both rotationally and longitudinally cyclically against the bore hole surfaces.

While the invention has been described and illustrated in detail, it is clearly to be understood that this is intended by way of illustration and example only, and is not to be taken by way of limitation, the spirit and scope of this invention being limited only by the terms of the following claims.

I claim:

1. A drive system for cycloidally driving a drill around the side walls of a bore hole to effect rotation of a cutting bit comprising:

a drill stem, said bit being mounted on the down hole end of said stem, said stem having its diameter slightly less than that of said bore hole, an eccentric mass rotor, means for rotatably supporting said rotor within said drill stem at a down hole position therealong spaced from the opposite ends of said stem and in an upper region of said stem, and means for rotatably driving said rotor, thereby generating a rotating force vector in a plane generally transverse of the bore hole, said force vector acting on said upper region of said system so as to cause said upper region of said system formed by the stem and drill bit to precess with a conical motion around the side wall of the bore hole in forceful driving engagement thereagainst, with said bit rotating as a pivot at the apex of said conical motion in pinned down engagement against the bottom of said bore hole.

2. The system of claim 1 in which said rotor is oriented to generate a force vector along an axis generally parallel to the longitudinal axis of the bore hole in addition to the force vector generated transverse of the bore hole.

3. The drill system of claim 1 wherein the rotation axis of the rotor is substantially parallel to the longitudinal axis of the bore hole.

4. The drill system of claim 1 wherein the rotation axis of the rotor is angulated with respect to the longitudinal axis of the bore hole.

5. The system of claim 1 and further including resilient bumper guard means surrounding said stem in the region of said rotor, said bumper guard means comprising the bore hole wall engaging portion of said system.

6. The system of claim 1 and additionally including a second unbalanced rotor mounted in said stem and means for rotatably driving said second rotor at a speed such as to cause vibration of the drill stem with orientation for longitudinal vibration.

* * * * *